US012376685B2

(12) United States Patent
Wang et al.

(10) Patent No.: US 12,376,685 B2
(45) Date of Patent: Aug. 5, 2025

(54) ADJUSTABLE BED

(71) Applicant: Nisco Co., Ltd, Jiangsu (CN)

(72) Inventors: Wei Wang, Jiangsu (CN); Jian Xie, Jiangsu (CN)

(73) Assignee: NISCO CO., LTD, Jiangsu (CN)

( * ) Notice: Subject to any disclaimer, the term of this patent is extended or adjusted under 35 U.S.C. 154(b) by 1025 days.

(21) Appl. No.: 17/402,810

(22) Filed: Aug. 16, 2021

(65) Prior Publication Data

US 2021/0368993 A1 Dec. 2, 2021

Related U.S. Application Data

(63) Continuation-in-part of application No. 16/867,674, filed on May 6, 2020, now Pat. No. 11,330,911.

(60) Provisional application No. 63/069,858, filed on Aug. 25, 2020, provisional application No. 62/962,324, filed on Jan. 17, 2020, provisional application No. 62/947,561, filed on Dec. 13, 2019.

(51) Int. Cl.
*A47C 20/04* (2006.01)

(52) U.S. Cl.
CPC ..... *A47C 20/041* (2013.01)

(58) Field of Classification Search
None
See application file for complete search history.

(56) References Cited

FOREIGN PATENT DOCUMENTS

DE 102015122605 A1 * 6/2017 ..... A47C 19/005

* cited by examiner

*Primary Examiner* — Adam C Ortiz
(74) *Attorney, Agent, or Firm* — troutman pepper locke; Tim Tingkang Xia, Esq.

(57) ABSTRACT

An adjustable bed with a smooth transitional profile includes a pair of lifting assemblies each having back lifting arm and a lumbar supporting mechanism coupled with the back lifting arm such that when the back lifting arm is positioned in parallel to a co-plane of the pair of side rails, the seat platform, the top back platform and the lower back platform are aligned in a co-plane, and the adjustable bed is in a plane state; and when the back lifting arm is driven to rotate in the upward or downward rotation direction, the lower back platform has an angle relative to the top back platform, the angle being less than 180° and greater than 90°; and the adjustable bed is in an adjusted state.

11 Claims, 7 Drawing Sheets

ADJUSTABLE BED

CROSS-REFERENCE TO RELATED PATENT APPLICATIONS

This application claims priority to and the benefit of U.S. Provisional Patent Application Ser. No. 63/069,858, filed Aug. 25, 2020, which is incorporated herein in its entirety by reference.

This application is a continuation-in-part application of U.S. patent application Ser. No. 16/867,674, filed May 6, 2020, which itself claims priority to and the benefit of U.S. Provisional Patent Application Ser. Nos. 62/947,561, filed Dec. 13, 2019 and 62/962,324, filed Jan. 17, 2020, which are incorporated herein in their entireties by reference.

FIELD OF THE INVENTION

The invention generally relates to a bed, and more particular to an adjustable bed having a lumbar supporting mechanism with a smooth transitional profile.

BACKGROUND OF THE INVENTION

Sleep is critical for people in every aspect of their lives. Beds are necessary furniture for people to sleep on. A conventional bed usually has a fixed size, such as a king size, a queen size or a full size, which cannot be changed, without body positions adjustable, and also requires professionals to install. Thus, it is beneficial and desirable for people to have a bed system that is capable of adjusting body positions based on user's sleep preference so that the user achieves maximum comfort during sleep. In addition, it is also beneficial and desirable that the bed system can be easily assembled to improve assembly efficiency and increase the user's assembly experience. It is further beneficial and desirable that the size of the bed system can be changeable from one size to another size.

SUMMARY OF THE INVENTION

In one aspect, the invention relates to an adjustable bed having a lumbar supporting mechanism with a smooth transitional profile. The smooth transitional profile makes the mattress and the bed platforms/broads better fit on one hand. On the other hand, the smooth transitional profile can also greatly improve the comfort of the lumbar support and reduce the compression of the abdomen of the user caused by lifting.

The adjustable bed in one embodiment includes a pair of side rails transversely spaced, longitudinally aligned and arranged parallel to each other; and a pair of lifting assemblies attached respectively to the pair of side rails for operably adjusting positions of at least one part of a bed. Each lifting assembly comprises a back lifting arm assembly having a back lifting arm; a guiding bracket on the back lifting arm; and a support bar having one end movably received in the guiding bracket; a lifting assembly bracket attached to a respective one of the pair of side rails; and a back lifting actuator received in the lifting assembly bracket, wherein the back actuator comprises an activation member and a motor member engaged with the activation member for driving the activation member, wherein the activation member is engaged with the back lifting arm for driving the back lifting arm to operably rotate in upward or downward rotation direction so as to adjust the back lifting arm at desired back positions.

The adjustable bed also includes a plurality of platforms disposed on the pair of lifting assemblies, wherein the plurality of platforms comprises a seat platform, a top back platform, and a lower back platform, wherein the seat platform is mounted on the lifting assembly brackets of the pair of lifting assemblies; the top back platform is mounted on a top portion of the back lifting arm; and the lower back platform has a lower end portion hinged to the seat platform and a top end portion mounted to the support bar, such that when the back lifting arm is positioned in parallel to a co-plane of the pair of side rails, the seat platform, the top back platform and the lower back platform are in a co-plane, and the adjustable bed is in a plane state; and when the back lifting arm is driven to rotate in the upward or downward rotation direction, said end of the support bar moves upwards or downwards along the guiding bracket, and the lower back platform has an angle relative to the top back platform, the angle being less than 180° and greater than 90°; and the adjustable bed is in an adjusted (lifting) state.

In one embodiment, said end of the support bar is equipped with a wheel that is rotatably received in the guiding bracket.

In one embodiment, each lifting assembly further comprises a leg lifting mechanism; and a leg lifting actuator received in the lifting assembly bracket, wherein the leg lifting actuators comprises an activation member and a motor member engaged with the activation member for driving the activation member, wherein the activation member of the leg lifting actuator is engaged to the leg lifting mechanism for operably adjusting the leg lifting mechanism at desired leg positions.

In one embodiment, the activation member of each of the back lifting actuator and the leg lifting actuator comprises a driving shaft having a first portion and a second portion extending from the first portion, the second portion being engaged with the motor member, wherein the activation member of the back lifting actuator is engaged with the back lifting arm through engaging the first portion of the driving shaft with one end portion of the back lifting arm, and wherein the activation member of the leg lifting actuator is engaged with the leg lifting mechanism through engaging the first portion of the driving shaft with one end portion of the leg lifting mechanism.

In one embodiment, the driving shaft further has at least one claw protruded from the second portion such that the second portion is engaged with the motor member through the at least one claw.

In one embodiment, the activation member further comprises a shoulder mounted on the first portion of the driving shaft for engaging the first portion of the driving shaft with said one end portion of the back lifting arm or the leg lifting mechanism.

In one embodiment, the motor member comprises a body having an opening formed at one end portion and a motor mounted on the body, wherein the opening is configured for receiving the second portion of the driving shaft of the activation member so as to engage the motor member with the activation member.

In one embodiment, the leg lifting mechanism comprises first, second, third and fourth supporting members, wherein a first end of the first supporting member is connected to the first portion of the driving shaft of the leg lifting actuator, first ends of the second and third supporting members are connected to a second end of the first supporting member, a first end of the fourth supporting member is connected to a second end of the third supporting member.

In one embodiment, the plurality of platforms further comprises a thigh platform and a leg platform coupled to the leg lifting mechanism, such that the thigh platform is rotatable around its upper edge in a thigh platform downward rotating direction or a thigh platform upward rotating direction, and the leg platform is rotatable around its upper edge in a leg platform downward rotating direction or a leg platform upward rotating direction.

In one embodiment, the adjustable bed also includes an upper rail and a lower rail being longitudinally spaced and transversely aligned, two ends of the upper rail being detachably connected to the first ends of the pair of side rails and two ends of lower rail being detachably connected to the second ends of the pair of side rails such that the upper rail and the lower rail are parallel to each other, wherein each of the upper rail and the lower rail has a length L that is adjustable or fixed and defines a size of the bed.

In one embodiment, the lifting assembly bracket comprises a base member attached to a respective one of the pair of side rails, a pair of tab members vertically attached to the base member, and a pair of bars transversely attached to top portions of the pair of tab members.

In one embodiment, one of the pair of tab members is attached to the base member and the other of the pair of tab members is attached to the respective side rail such that the pair of tab members is transversely spaced, longitudinally aligned and parallel to each other, and wherein the pair of bars is longitudinally spaced and transversely aligned and parallel to each other, wherein each tab member has two connecting holes defined at two end portions of said tab member, and the pair of bars is positioned between the connecting holes of the pair of tab members.

In one embodiment, each tab member comprises a single tab or a plurality of tabs.

In one embodiment, as assembled, the driving shaft of the activation member is rotatably connected to the pair of tab member through respective connecting holes and a groove formed in another end portion of the body of the motor member receives a respective one of the pair of bars, so that the back lifting actuator and the leg lifting actuator securely attached to the bracket.

In one embodiment, the adjustable bed further includes a controller configured to control operations of the back lifting actuator and the leg lifting actuator of each lifting assembly, so as to lift individually or cooperatively the back lifting arm and the leg lifting mechanism at desired leg positions.

These and other aspects of the invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
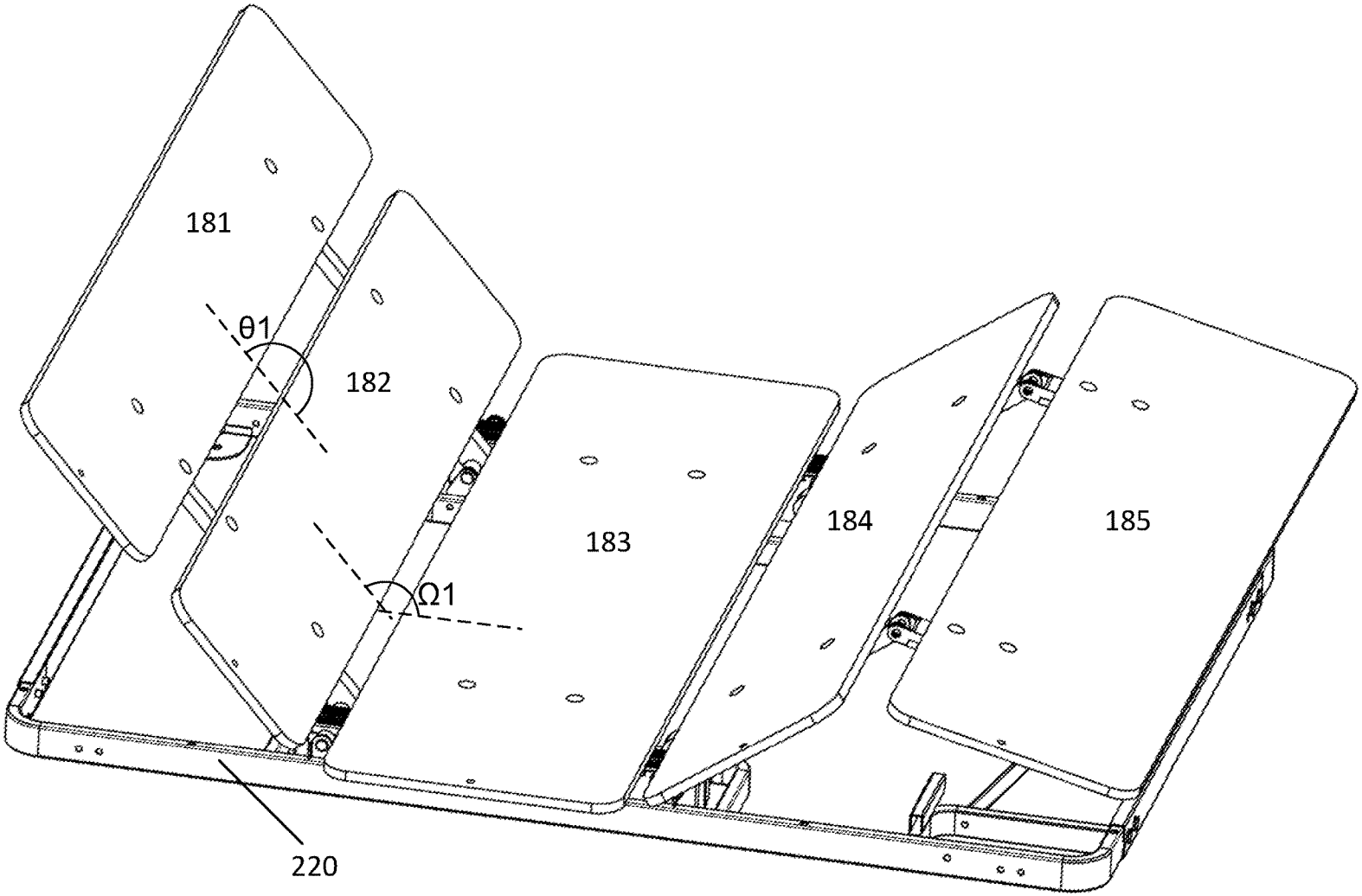
FIG. 1 shows schematically a perspective view of an adjustable bed in an adjusted (lifting) state according to one embodiment of the invention.

The present invention will now be described more fully hereinafter with reference to the accompanying drawings, in which exemplary embodiments of the present invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting and/or capital letters has no influence on the scope and meaning of a term; the scope and meaning of a term are the same, in the same context, whether or not it is highlighted and/or in capital letters. It will be appreciated that the same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only and in no way limits the scope and meaning of the invention or of any exemplified term. Likewise, the invention is not limited to various embodiments given in this specification.

The terminology used herein is for the purpose of describing particular embodiments only and is not intended to be limiting of the invention. As used herein, the singular forms "a," "an," and "the" are intended to include the plural forms as well, unless the context clearly indicates otherwise.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" to another feature may have portions that overlap or underlie the adjacent feature.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below can be termed a second element, component, region, layer or section without departing from the teachings of the present invention.

Furthermore, relative terms, such as "lower" or "bottom" and "upper" or "top," may be used herein to describe one element's relationship to another element as illustrated in the figures. It will be understood that relative terms are intended to encompass different orientations of the device in addition to the orientation shown in the figures. For example, if the device in one of the figures is turned over, elements described as being on the "lower" side of other elements would then be oriented on the "upper" sides of the other elements. The exemplary term "lower" can, therefore, encompass both an orientation of lower and upper, depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

It will be further understood that the terms "comprise(s)" and/or "comprising," or "include(s)" and/or "including" or "has (have)" and/or "having" or "contain(s)" and/or "containing" when used in this specification specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around," "about," "substantially" or "approximately" shall generally mean within 20 percent, preferably within 10 percent, and more preferably within 5 percent of a given value or range. Numerical quantities given herein are approximate, meaning that the terms "around," "about," "substantially" or "approximately" can be inferred if not expressly stated.

As used in this specification, the phrase "at least one of A, B, and C" should be construed to mean a logical (A or B or C), using a non-exclusive logical OR. As used herein, the term "and/or" includes any and all combinations of one or more of the associated listed items.

Embodiments of the invention are illustrated in detail hereinafter with reference to accompanying drawings. The description below is merely illustrative in nature and is in no way intended to limit the invention, its application, or uses. The broad teachings of the invention can be implemented in a variety of forms. Therefore, while this invention includes particular examples, the true scope of the invention should not be so limited since other modifications will become apparent upon a study of the drawings, the specification, and the following claims. For purposes of clarity, the same reference numbers will be used in the drawings to identify similar elements. It should be understood that one or more steps within a method may be executed in different order (or concurrently) without altering the principles of the invention.

The description will be made as to the embodiments of the invention in conjunction with the accompanying drawings in FIGS. 1-5 and 6A-6D. In accordance with the purposes of this invention, as embodied and broadly described herein, this invention, in one aspect, relates to an adjustable bed having a lumbar supporting mechanism with a smooth transitional profile.

The adjustable bed of the invention represents an improvement to the adjustable bed disclosed in U.S. patent application Ser. No. 16/867,674, which is incorporated herein in its entirety by reference. The structure and operations of the adjustable bed according to this invention are substantially similar to that of the adjustable bed disclosed in U.S. patent application Ser. No. 16/867,674, except that the adjustable bed of the invention has a lumbar supporting mechanism with a smooth transitional profile. The detailed description of the structure and operations of the adjustable bed of the invention is referred to the disclosure of U.S. patent application Ser. No. 16/867,674, which is incorporated herein in its entirety by reference.

Figure 2:
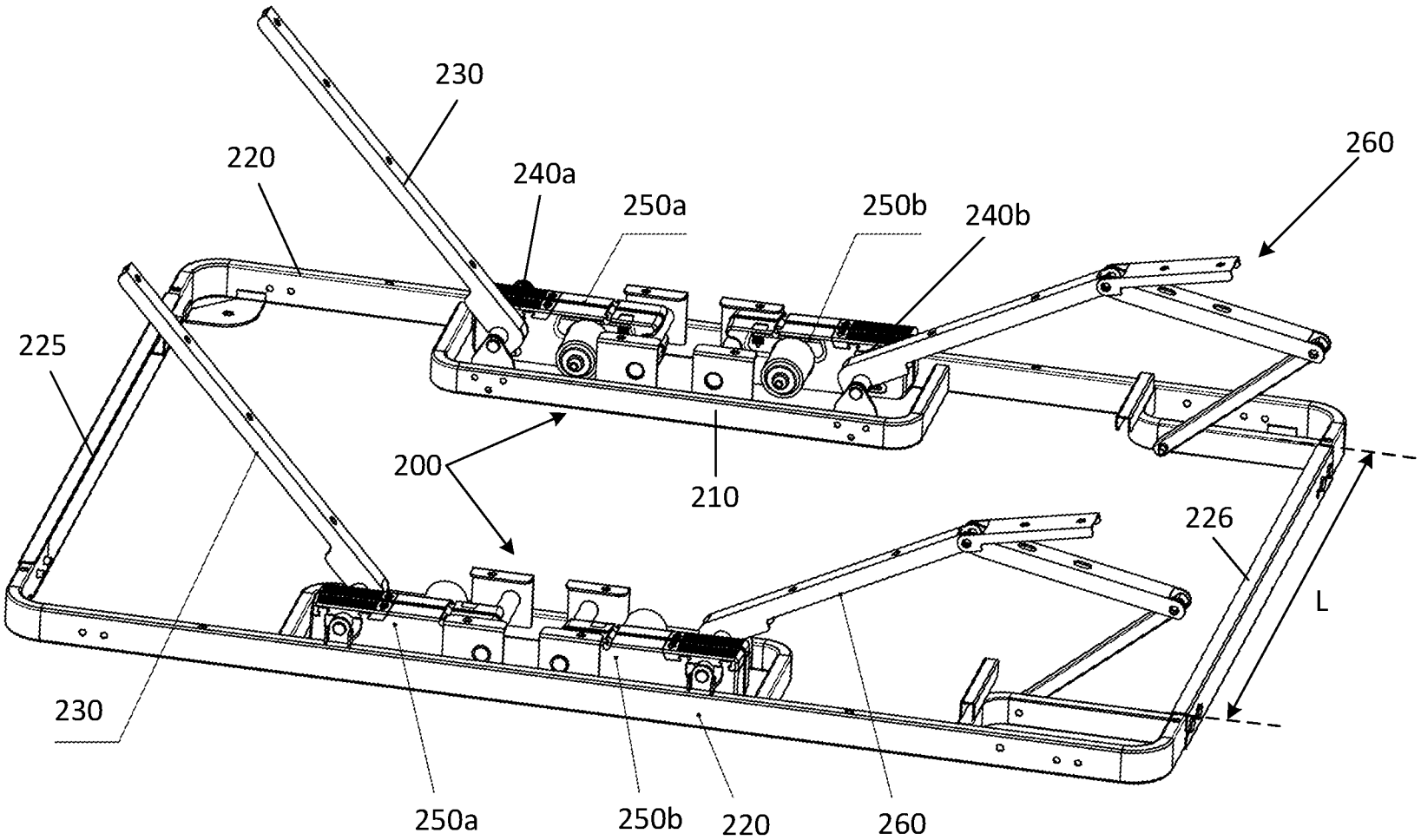
FIG. 2 shows schematically another perspective view of the adjustable bed shown in FIG. 1.
Figure 3:
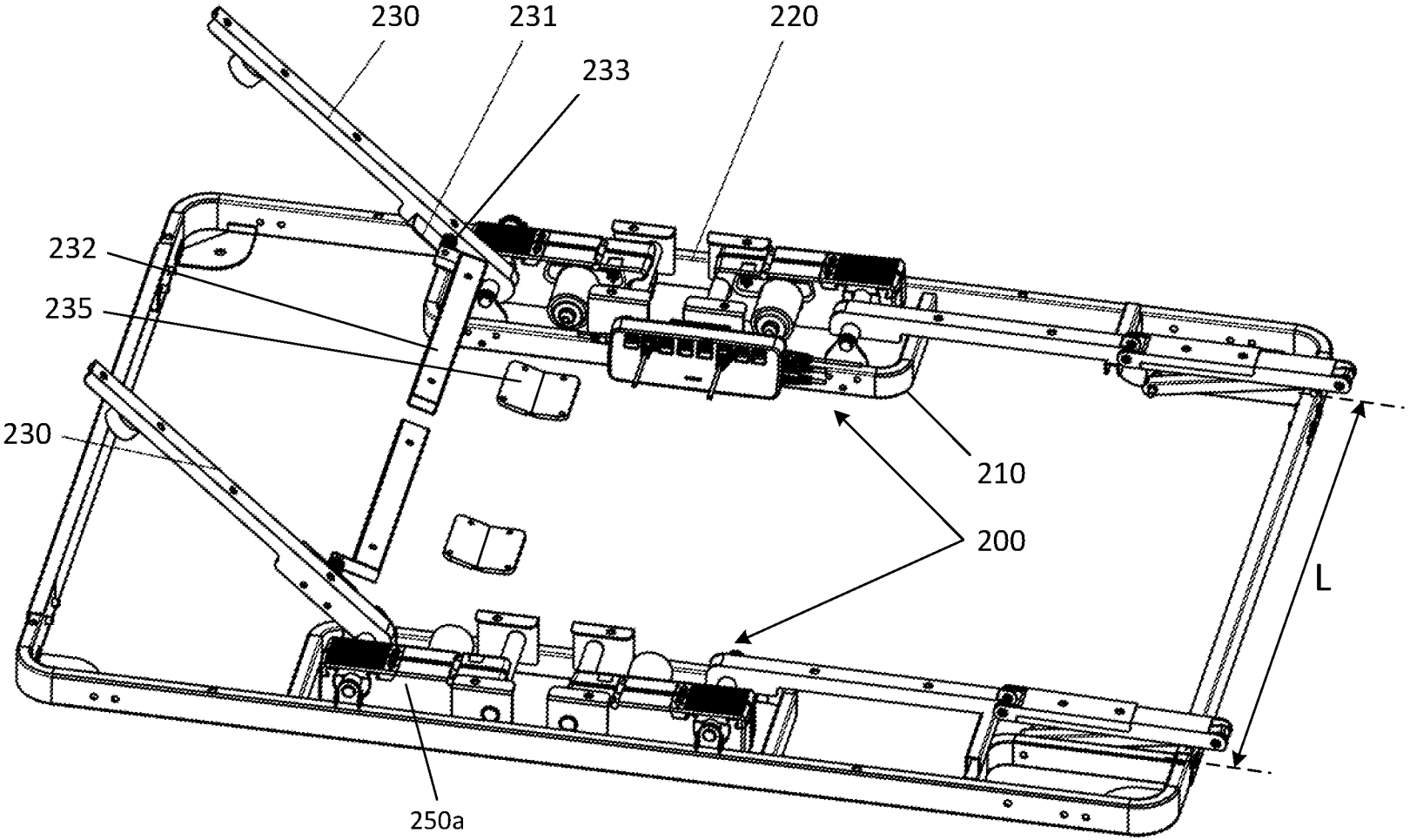
FIG. 3 shows schematically a perspective view of an adjustable bed in an adjusted state according to another embodiment of the invention.
Figure 4:
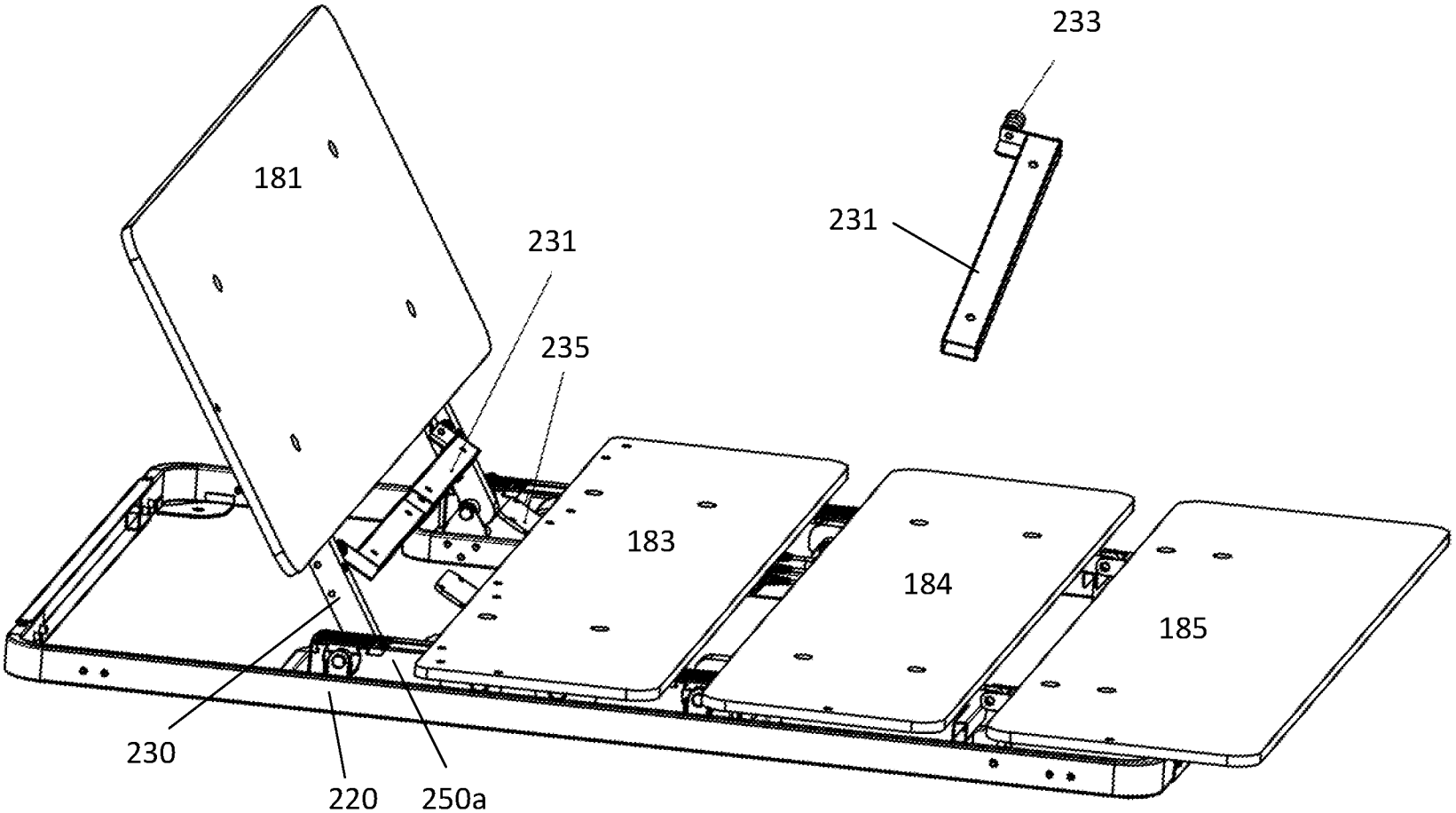
FIG. 4 shows schematically another perspective view of the adjustable bed shown in FIG. 3.

FIGS. 1-2 show one embodiment of the adjustable bed of the invention. The adjustable bed includes a pair of side rails 220 transversely spaced, longitudinally aligned and arranged parallel to each other. The adjustable bed also includes an upper rail 225 and a lower rail 226 being longitudinally spaced and transversely aligned. Two ends of the upper rail 225 are detachably connected to the upper end portions of the pair of side rails 220 and two ends of lower rail 226 are detachably connected to the lower end portions of the pair of side rails 220 such that the upper rail 225 and the lower rail 226 are parallel to each other, and the upper rail 225 and the lower rail 226 and the pair of side rails 220 are co-planar in a rectangle form, as shown in FIG. 2 for example. These connections can be screw-type connections or any other connection means. In addition, each of the upper rail 225 and the lower rail 226 has a length L that is adjustable or fixed and defines a size of the bed. For example, if a user wants to convert the bed system from one size to another size, e.g., from a queen size to a king size, the user only needs to adjust the length L of the upper rail 225 and the lower rail 226 to fit the king size, or replace the queen size upper rail 225 and lower rail 226 with the king size upper rail 225 and lower rail 226.

The adjustable bed further includes a pair of lifting assemblies 200 attached respectively to the pair of side rails 220 for operably adjusting positions of at least one part of a bed. Each lifting assembly 200 comprises a back lifting arm 230 and a leg lifting mechanism 260, a lifting assembly bracket 210, and a back lifting actuator 240*a* and 250*a* and a leg lifting actuator 240*b* and 250*b* that are received in the lifting assembly bracket 210.

The back lifting actuator comprises an activation member 240*a* and a motor member 250*a* engaged with the activation member 240*a* for driving the activation member 240*a*. The activation member 240*a* is engaged with the back lifting arm 230 for operably adjusting the back lifting arm 230 at desired back positions.

The activation member 240*a* comprises a driving shaft having a first portion and a second portion extending from the first portion, the second portion being engaged with the motor member 250*a*. The activation member 240*a* is engaged with the back lifting arm 230 through engaging the first portion of the driving shaft with one end portion of the back lifting arm 230. The driving shaft may further have at least one claw protruded from the second portion such that the second portion is engaged with the motor member 250*a* through the at least one claw. The activation member 240*a* may have a shoulder mounted on the first portion of the driving shaft for engaging the first portion of the driving shaft with said one end portion of the back lifting arm 230. The motor member 250*a* comprises a body having an opening formed at one end portion and a motor mounted on the body, wherein the opening is configured for receiving the second portion of the driving shaft of the activation member 240*a* so as to engage the motor member 250*a* with the activation member 240*a*.

In operation, the rotation of the motor drives the driving shaft to rotate accordingly. The rotation of the driving shaft in turn drives the back lifting arm 230 to rotate around its lower end portion so as to adjust the back lifting arm 230 at desired positions. In the upward rotation of the back lifting arm 230, the motor drives the driving shaft to rotate, thereby driving the back rotating arm 230 to move upward, as shown in FIG. 1. In the downward rotation of the back lifting arm 230, because the back lifting arm 230 and the shoulder of the driving shaft are connected by the shoulder bolt connection, they can move freely. If there is an obstacle below the back platforms/boards 181 and 182 in the space, the back platforms/boards 181 and 182 installed on the back lifting arm 130 will rest on the obstacle, and will not continue moving down, thereby preventing pinching from the downward rotation of the back lifting arm 230.

Similarly, the leg lifting actuator 240*b* and 250*b* comprises an activation member 240*b* and a motor member 250*b* engaged with the activation member 240*b* for driving the activation member 240*b*. The activation member 240*b* is engaged with the leg lifting mechanism 260 for operably adjusting the leg lifting mechanism 260 at desired leg positions.

The activation member 240*b* comprises a driving shaft having a first portion and a second portion extending from the first portion. The second portion is used to engage with the motor member 250*b*. The driving shaft may further have claws protruded from the second portion such that the second portion is engaged with the motor member through the claws. The activation member 240*b* is also engaged with the leg lifting mechanism 160 through engaging the first portion of the driving shaft with one end portion of the leg lifting mechanism 260.

The adjustable bed further includes a plurality of platforms 181-185 disposed on the pair of lifting assemblies 200 and coupled with the back lifting arm 230 and the leg lifting mechanism 260 such that positions of at least one or more of the plurality of platforms 181-185 are adjustable in accordance with operations of the back lifting arm 230 and the leg lifting mechanism 260. As shown in FIG. 1, the plurality of platforms 181-185 comprises a seat platform 183 mounted on tops of the lifting assembly brackets 210 of the lifting assemblies 200; a upper back platform 181 and a lower back platform 182 are mounted on the back lifting arm 130. Therefore, the upper and lower back platforms 181 and 182 are in a co-plane, i.e., the top back platform 181 and the lower back platform 182 have an angle, $\theta 1=180°$. Accordingly, the upper and lower back platforms 181 and 182 are co-rotatable around its lower edge of the lower back platform 182 in a back platform downward rotation direction or a back platform upward rotation direction. The plurality of platforms 181-185 also comprises a thigh platform 184 and a leg platform 185 coupled to the leg lifting mechanism 160, such that the thigh platform 184 is rotatable around its upper edge in a thigh platform downward rotating direction or a thigh platform upward rotating direction, and the leg platform is rotatable around its upper edge in a leg platform downward rotating direction or a leg platform upward rotating direction.

The adjustable bed is capable of adjusting body positions based on user's sleep preference so that the user achieves maximum comfort during sleep. As shown in FIG. 1, when the adjustable bed in an adjusted (lifting) state, the top back platform 181 and the lower back platform 182 are co-planed, i.e., $\theta 1=180°$, and the lower back platform 182 (also the top back platform 181) has an angle, $\Omega 1$, relative to the seat platform 183, where $90°<\Omega 1<180°$. However, when the back lifting arm 230 is driven to rotate in the upward rotation direction to adjust the adjustable bed from the plane state, where all the platforms 181-185 are in a co-plane, to the adjusted (lifting) state, for example, as shown in FIG. 1, the lifting (upward rotation) of the co-planed upper and lower platforms 181 and 182 may cause compression of the abdomen of the user, thereby resulting in some discomfort.

In order to address this issue, one aspect of the invention provides an adjustable bed having a lumbar/waist supporting mechanism with a smooth transitional profile. As shown in FIGS. 3-5 and 6A-6D, the adjustable bed is structurally and operably similar to that of the adjustable bed shown in FIGS. 1-2. In addition, the adjustable bed also has a lumbar/waist supporting mechanism with a smooth transitional profile.

In this exemplary embodiment shown in FIGS. 3-5 and 6A-6D, the lumbar/waist supporting mechanism includes a guiding bracket 231 mounted on or integrated with (e.g., the lower portion of) the back lifting arm 230; and a support bar 232 having one end 233 movably received in the guiding bracket 231. In some embodiments, said end of the support bar 232 comprises a wheel that is rotatably and/or slidably on the guiding bracket 231. As assembled, the top back platform 181 is mounted on a top portion of the back lifting arm 230, and the lower back platform 182 has a lower end portion hinged to the seat platform 183 by hinge plates 235 and a top end portion mounted to the support bar 232. The seat platform 183 is mounted on the lifting assembly brackets 210 of the pair of lifting assemblies 200.

Figure 5:
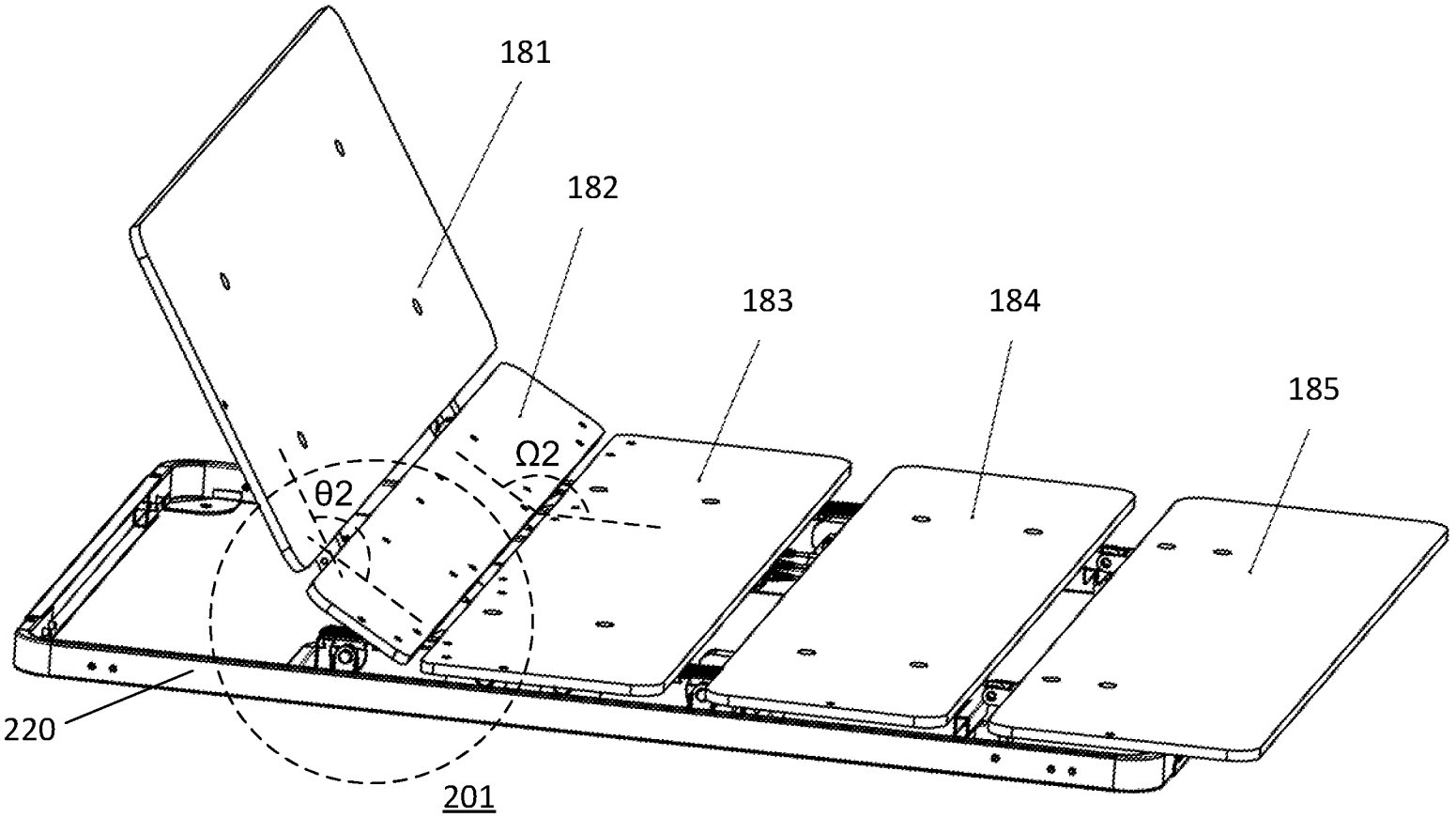
FIG. 5 shows schematically yet another perspective view of the adjustable bed shown in FIG. 3.
Figure 6B:
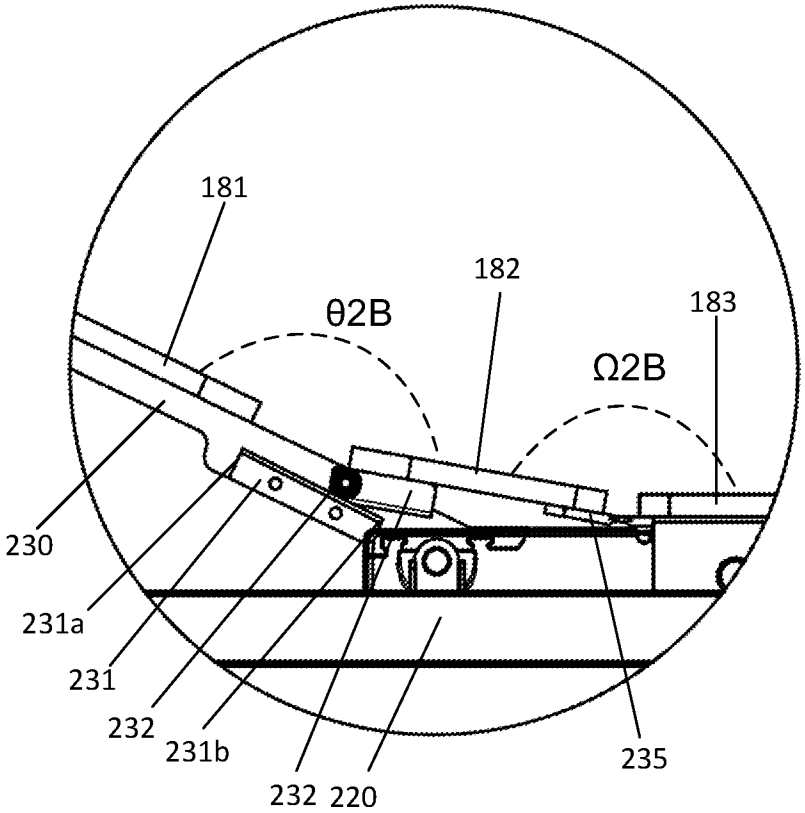
FIGS. 6A-6D show schematically operations of the adjustable bed shown in FIG. 3.
Figure 6A:
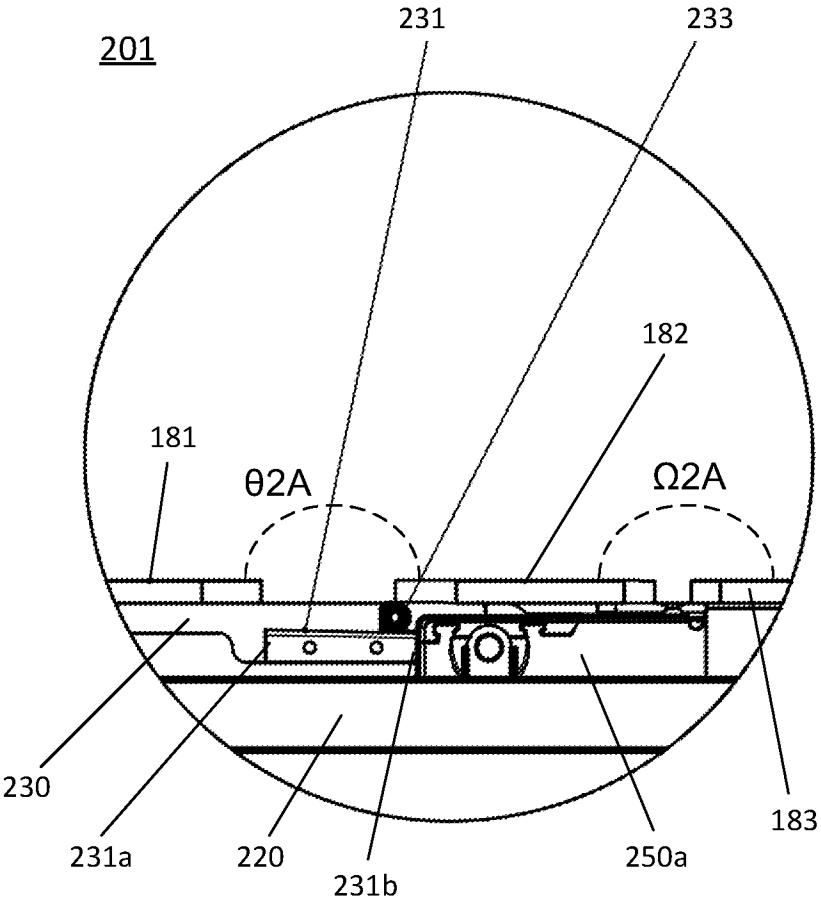

As such, when the back lifting arm 230 is positioned in parallel to a co-plane of the pair of side rails 220, the seat platform 183, the top back platform 181 and the lower back platform 182 are all aligned in a co-plane, and the adjustable bed is in the plane state (FIG. 6A). When the back lifting arm 230 is driven to rotate in the upward rotation direction from the position of the plane state, said end 233 of the support bar 232 moves upwards along the guiding bracket 231, whereby the top back platform 181 rotates upwards around the lower end of the back lifting arm 230, while the lower back platform 182 rotates upwards around the hinged lower end of the lower back platform 182 so that the lower back platform 182 and the upper back platform 181 are not aligned in the co-plane. As the angle of the back lifting arm 230 becomes larger, the angle of the lower back platform 182 gradually becomes larger, and gradually moves away from the back lifting arm 230, so that the lower back platform 182 will not rub against the back lifting arm 230 during the movement. Accordingly, the lower back platform 182 has an angle, $\theta 2$, relative to the top back platform 181, the angle $\theta 2$ being less than 180° and greater than 90°, while the lower back platform 182 has an angle, $\Omega 2$, relative to the seat platform 183, the angle $\Omega 2$ being less than 180° and greater than 90°, where the adjustable bed is in the adjusted (lifting) state (FIGS. 5 and 6B-6D). Compared with the adjustable bed shown in FIG. 1 (without the lumbar/waist supporting mechanism) and the adjustable bed with the lumbar/waist supporting mechanism shown in FIG. 5, when the adjustable bed is in the adjusted (lifting) state, Ω2 is greater than Ω1, while 90°<θ2<180°, where the seat platform 183, the lower back platform 182 and the upper back platform 181 define a smooth transitional profile, which can also greatly improve the comfort of the lumbar support and reduce the compression of the abdomen of the user caused by lifting.

Figure 6D:
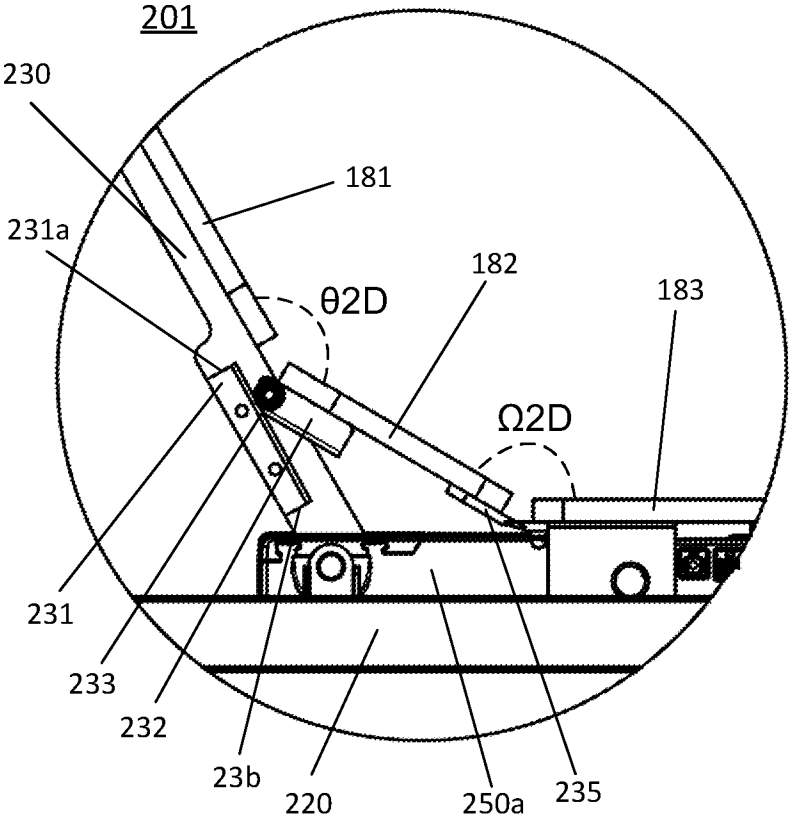
Figure 6C:
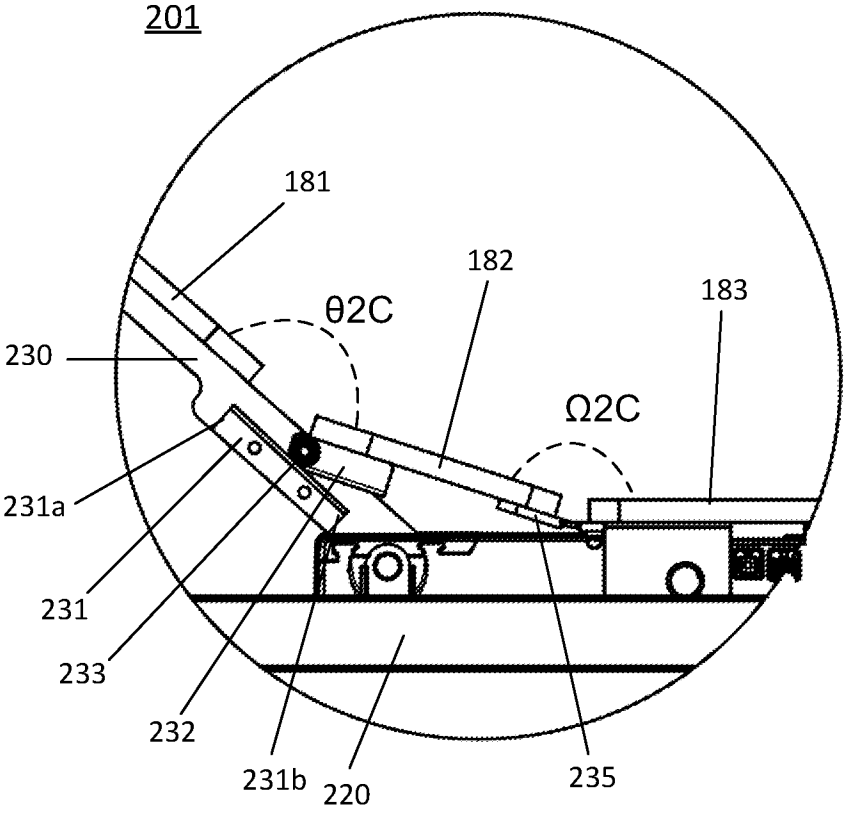

Referring to FIGS. 6A-6D, only is a portion 201 of the adjustable bed of FIG. 5 shown to illustrate the operations of the adjustable bed. FIG. 6A shows the adjustable bed in the plane state, while FIGS. 6C-6D show the adjustable bed in various adjusted states according to the user's preference.

As shown in FIG. 6A, in the plane state, all the seat platform 183, the lower back platform 182 and the upper back platform 181 are aligned in the co-plane, each of the angle θ2A between the lower back platform 182 and the upper back platform 181 and the angle Ω2A between the lower back platform 182 and the seat platform 183 is 180°, and the wheel 233 of the support bar 232 is on the guiding bracket 231 proximal to its lower end 231*b*.

When the back lifting arm 230 is driven to rotate in the upward rotation direction from the position of the plane state, the wheel 233 of the support bar 232 moves upwards along the guiding bracket 231, i.e., being apart from the lower end 231*b* of the guiding bracket 231, whereby the top back platform 181 rotates upwards around the lower end of the back lifting arm 230, while the lower back platform 182 rotates upwards around the hinged lower end of the lower back platform 182 so that the lower back platform 182 and the upper back platform 181 are not aligned in the co-plane. Accordingly, the angle θ2B between the lower back platform 182 and the upper back platform 181 becomes less than 180°, and the angle Ω2B between the lower back platform 182 and the seat platform 183 becomes also less than 180°, as shown in FIG. 6B.

When the back lifting arm 230 is driven to further rotate in the upward rotation direction, as shown in FIG. 6C, the angle θ2C between the lower back platform 182 and the upper back platform 181 becomes less than θ2B, and the angle Ω2C between the lower back platform 182 and the seat platform 183 becomes also less than Ω2B.

As shown in FIG. 6D, where the back lifting arm 230 is driven to rotate upwards in most, the wheel 233 of the support bar 232 moves to the upper end 231*a* of the guiding bracket 231, each of the angle θ2D between the lower back platform 182 and the upper back platform 181 and the angle Ω2D between the lower back platform 182 and the seat platform 183 reaches to its minimal angle. In this case, θ2D<θ2C and Ω2D<Ω2C.

In each adjusted state shown in FIGS. 6B-6D, Ω2B, Ω2C or Ω2D is greater than Ω1 of the adjustable bed without the lumbar/waist supporting mechanism (FIG. 1). The smooth transitional profile defined by the seat platform 183, the lower back platform 182 and the upper back platform 181 can greatly improve the comfort of the lumbar support and reduce the compression of the abdomen of the user caused by lifting.

In addition, the downward rotation of the back lifting arm 230 results in the adjustable bed adjusted from the adjusted state to the plane state.

In controlling the operations, a controller is configured to control operations of the back lifting actuator (motor) 250*a* and the leg lifting actuator (motor) 250*b*, respectively, so as to lift individually or cooperatively the platforms 181-185 in desired positions.

In sum, the invention provides an adjustable bed that is capable of adjusting body positions based on user's sleep preference so that the user achieves maximum comfort during sleep, and can be easily assembled to improve assembly efficiency and increase the user's assembly experience. In addition, the size of the adjustable bed can be changeable from one size to another size. Further, the smooth transitional profile makes the mattress and the bed platforms/broads better fit on one hand. On the other hand, the smooth transitional profile can also greatly improve the comfort of the lumbar support and reduce the compression of the abdomen of the user caused by lifting.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the invention pertains without departing from its spirit and scope. Accordingly, the scope of the invention is defined by the appended claims rather than the foregoing description and the exemplary embodiments described therein.

What is claimed is:

1. An adjustable bed, comprising:

a pair of side rails transversely spaced, longitudinally aligned and arranged parallel to each other;

a pair of lifting assemblies attached respectively to the pair of side rails for operably adjusting positions of at least one part of a bed, wherein each lifting assembly comprises:

a back lifting arm assembly having a back lifting arm; a guiding bracket on the back lifting arm; and a support bar having one end movably received in the guiding bracket, wherein said end of the support bar comprises a wheel that is rotatably and/or slidably on the guiding bracket;

a lifting assembly bracket attached to a respective one of the pair of side rails; and a back lifting actuator received in the lifting assembly bracket, wherein the back actuator comprises an activation member and a motor member engaged with the activation member for driving the activation member, wherein the activation member is engaged with the back lifting arm for driving the back lifting arm to operably rotate in upward or downward rotation direction so as to adjust the back lifting arm at desired back positions; and a plurality of platforms disposed on the pair of lifting assemblies, wherein the plurality of platforms comprises a seat platform, a top back platform, and a lower back platform, wherein the seat platform is mounted on the lifting assembly brackets of the pair of lifting assemblies; the top back platform is mounted on a top portion of the back lifting arm; and the lower back platform has a lower end portion hinged to the seat platform and a top end portion mounted to the support bar, such that when the back lifting arm is positioned in parallel to a co-plane of the pair of side rails, the seat platform, the top back platform and the lower back platform are aligned in a co-plane, and the adjustable bed is in a plane state; and when the back lifting arm is driven to rotate in the upward or downward rotation direction, said end of the support bar moves upwards or downwards along the guiding bracket, and the lower back platform has an angle relative to the top back platform, the angle being less than 180° and greater than 90°; and the adjustable bed is in an adjusted state.

2. The adjustable bed of claim 1, wherein each lifting assembly further comprises:

a leg lifting mechanism; and a leg lifting actuator received in the lifting assembly bracket, wherein the leg lifting actuators comprises an activation member and a motor member engaged with the activation member for driving the activation member, wherein the activation member of the leg lifting actuator is engaged to the leg lifting mechanism for operably adjusting the leg lifting mechanism at desired leg positions.

3. The adjustable bed of claim 2, wherein the activation member of each of the back lifting actuator and the leg lifting actuator comprises a driving shaft having a first portion and a second portion extending from the first portion, the second portion being engaged with the motor member, wherein the activation member of the back lifting actuator is engaged with the back lifting arm through engaging the first portion of the driving shaft with one end portion of the back lifting arm, and wherein the activation member of the leg lifting actuator is engaged with the leg lifting mechanism through engaging the first portion of the driving shaft with one end portion of the leg lifting mechanism.

4. The adjustable bed of claim 3, wherein the driving shaft further has at least one claw protruded from the second portion such that the second portion is engaged with the motor member through the at least one claw.

5. The adjustable bed of claim 3, wherein the activation member further comprises a shoulder mounted on the first portion of the driving shaft for engaging the first portion of the driving shaft with said one end portion of the back lifting arm or the leg lifting mechanism.

6. The adjustable bed of claim 3, wherein the motor member comprises a body having an opening formed at one end portion and a motor mounted on the body, wherein the opening is configured for receiving the second portion of the driving shaft of the activation member so as to engage the motor member with the activation member.

7. The adjustable bed of claim 2, wherein the leg lifting mechanism comprises first, second, third and fourth supporting members, wherein a first end of the first supporting member is connected to the first portion of the driving shaft of the leg lifting actuator, first ends of the second and third supporting members are connected to a second end of the first supporting member, a first end of the fourth supporting member is connected to a second end of the third supporting member.

8. The adjustable bed of claim 7, wherein the plurality of platforms further comprises a thigh platform and a leg platform coupled to the leg lifting mechanism, such that the thigh platform is rotatable around its upper edge in a thigh platform downward rotating direction or a thigh platform upward rotating direction, and the leg platform is rotatable around its upper edge in a leg platform downward rotating direction or a leg platform upward rotating direction.

9. The adjustable bed of claim 1, further comprising a controller configured to control operations of the back lifting actuator and the leg lifting actuator of each lifting assembly, so as to lift individually or cooperatively the back lifting arm and the leg lifting mechanism at desired leg positions.

10. The adjustable bed of claim 1, further comprising an upper rail and a lower rail being longitudinally spaced and transversely aligned, two ends of the upper rail being detachably connected to the first ends of the pair of side rails and two ends of lower rail being detachably connected to the second ends of the pair of side rails such that the upper rail and the lower rail are parallel to each other, wherein each of the upper rail and the lower rail has a length that is adjustable or fixed and defines a size of the bed.

11. An adjustable bed, comprising:

a pair of side rails transversely spaced, longitudinally aligned and arranged parallel to each other;

a pair of lifting assemblies attached respectively to the pair of side rails for operably adjusting positions of at least one part of a bed, wherein each lifting assembly comprises:

a back lifting arm assembly having a back lifting arm; a guiding bracket on the back lifting arm; and a support bar having one end movably received in the guiding bracket;

a lifting assembly bracket attached to a respective one of the pair of side rails; and a back lifting actuator received in the lifting assembly bracket, wherein the back actuator comprises an activation member and a motor member engaged with the activation member for driving the activation member, wherein the activation member is engaged with the back lifting arm for driving the back lifting arm to operably rotate in upward or downward rotation direction so as to adjust the back lifting arm at desired back positions; and a plurality of platforms disposed on the pair of lifting assemblies, wherein the plurality of platforms comprises a seat platform, a top back platform, and a lower back platform, wherein the seat platform is mounted on the lifting assembly brackets of the pair of lifting assemblies; the top back platform is mounted on a top portion of the back lifting arm; and the lower back platform has a lower end portion hinged to the seat platform and a top end portion mounted to the support bar, such that when the back lifting arm is positioned in parallel to a co-plane of the pair of side rails, the seat platform, the top back platform and the lower back platform are aligned in a co-plane, and the adjustable bed is in a plane state; and when the back lifting arm is driven to rotate in the upward or downward rotation direction, said end of the support bar moves upwards or downwards along the guiding bracket, and the lower back platform has an angle relative to the top back platform, the angle being less than 180° and greater than 90°; and the adjustable bed is in an adjusted state;

wherein each lifting assembly further comprises:

a leg lifting mechanism; and a leg lifting actuator received in the lifting assembly bracket, wherein the leg lifting actuators comprises an activation member and a motor member engaged with the activation member for driving the activation member, wherein the activation member of the leg lifting actuator is engaged to the leg lifting mechanism for operably adjusting the leg lifting mechanism at desired leg positions;

wherein the activation member of each of the back lifting actuator and the leg lifting actuator comprises a driving shaft having a first portion and a second portion extending from the first portion, the second portion being engaged with the motor member, wherein the activation member of the back lifting actuator is engaged with the back lifting arm through engaging the first portion of the driving shaft with one end portion of the back lifting arm, and wherein the activation member of the leg lifting actuator is engaged with the leg lifting mechanism through engaging the first portion of the driving shaft with one end portion of the leg lifting mechanism.

* * * * *